United States Patent [19]

Rosenberg

[11] 4,005,723

[45] Feb. 1, 1977

[54] POOL CLEANING DEVICE

[76] Inventor: Jeffrey P. Rosenberg, 1270 Stillwater Drive, Miami Beach, Fla. 33141

[22] Filed: Aug. 4, 1975

[21] Appl. No.: 601,449

[52] U.S. Cl. ..... 134/167 R; 134/180; 239/246; 239/251

[51] Int. Cl.[2] ..... B08B 9/00; B08B 3/02

[58] Field of Search ..... 134/56 R, 167 R, 168 R, 134/179–181, 176; 15/1.7; 239/191–192, 246, 251; 4/172.15, 172.16, 172.17

[56] References Cited

UNITED STATES PATENTS

| | | | |
|---|---|---|---|
| 1,721,237 | 7/1929 | Todd et al. | 239/246 X |
| 1,938,838 | 12/1933 | Jacobson | 239/251 X |
| 3,247,968 | 4/1966 | Miller | 4/172.17 X |
| 3,247,969 | 4/1966 | Miller | 134/168 R X |
| 3,295,540 | 1/1967 | Ortega | 134/167 R |
| 3,483,878 | 12/1969 | Lorenzen | 134/167 R |
| 3,598,132 | 8/1971 | Miller | 134/167 R |
| 3,770,203 | 11/1973 | Dyar | 134/179 X |

*Primary Examiner*—Robert L. Bleutge

[57] ABSTRACT

A pool cleaning device for use in connection with a pump to circulate water of a pool, which device includes a housing with an outlet and structure connecting the outlet to the circulating pump and a rotatable arm journaled to the housing including a jet to cause the arm to rotate and including an inlet to direct water from the pool toward the housing, so that debris which is in the water adjacent the bottom will be directed to exit through openings in the housing and through the outlet of the housing to be filtered in a filter which is conventionally included in the combination with a pool pump.

10 Claims, 3 Drawing Figures

POOL CLEANING DEVICE

FIELD OF THE INVENTION

This invention relates to pool cleaning devices and, more particularly, to a pool cleaning device which is adapted to rest on the bottom of a pool and to direct a stream of water over the bottom of the pool to urge debris to be drained from the pool and removed by exterior filtering means.

BACKGROUND OF THE INVENTION

In the past there have been numerous devices which have been utilized for cleaning pools because the problem of debris settling and collecting on the bottom of a pool is a constantly recurring problem of pool owners. Pool cleaning services are expensive and the operation is generally time-consuming and must be repeated often. The present invention is of a pool cleaning device which can be operated continuously when the pool is draining or being filtered by means of a conventional circulating pump and it is connected in series with the flow of water to and through the circulating pump and includes a housing which is arranged on the pool floor and includes an arm which is independently supplied with a flow of water to cause currents directing debris from a location radially outwardly of the housing which sits on the bottom of the pool toward inlet openings in the housing so that the debris is carried away in the drain to be filtered.

In accordance with these and other objects which have become apparent hereinafter, the instant invention will now be described with reference to the accompanying drawings in which:

DESCRIPTION OF THE DRAWINGS

FIG. 4 is a view in cross section taken on the plane indicated by the line 4—4 of FIG. 3 and looking in the direction of the arrows.

DESCRIPTION OF THE PREFERRED EMBODIMENT

Figure 1:
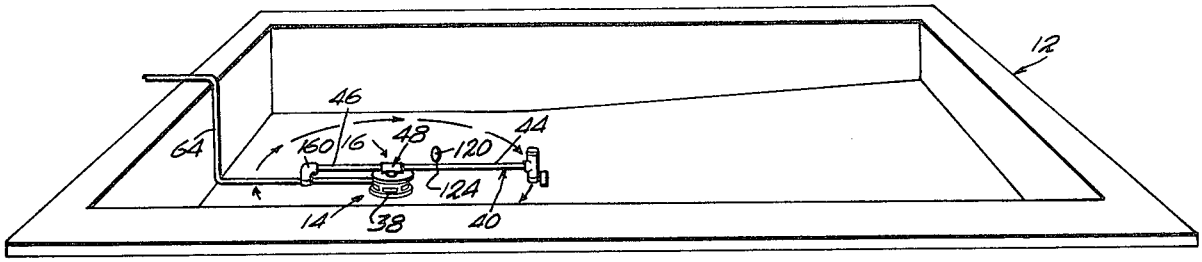
FIG. 1 is a perspective view of a pool having the instant invention installed in the drain opening of the pool.

Referring to the drawings wherein like reference characters designate like or corresponding parts throughout the several views there is shown in FIG. 1 a pool which is generally designated by the numeral 12 and which includes a drain opening in the deeper end zone 14. The pool cleaning device is generally designated by the numeral 16 and shown in more detail in FIG. 2.

Figure 2:
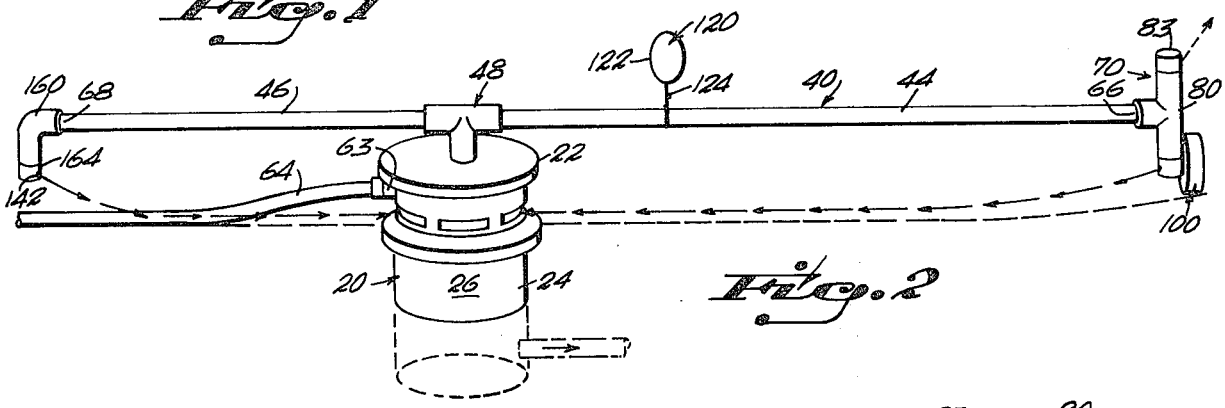
FIG. 2 is a perspective side view of the invention.

Referring to FIG. 2, it is seen that the device includes a housing 20 having an upper end 22 and a lower end 24 which are interconnected by side walls such as 26.

Figure 3:
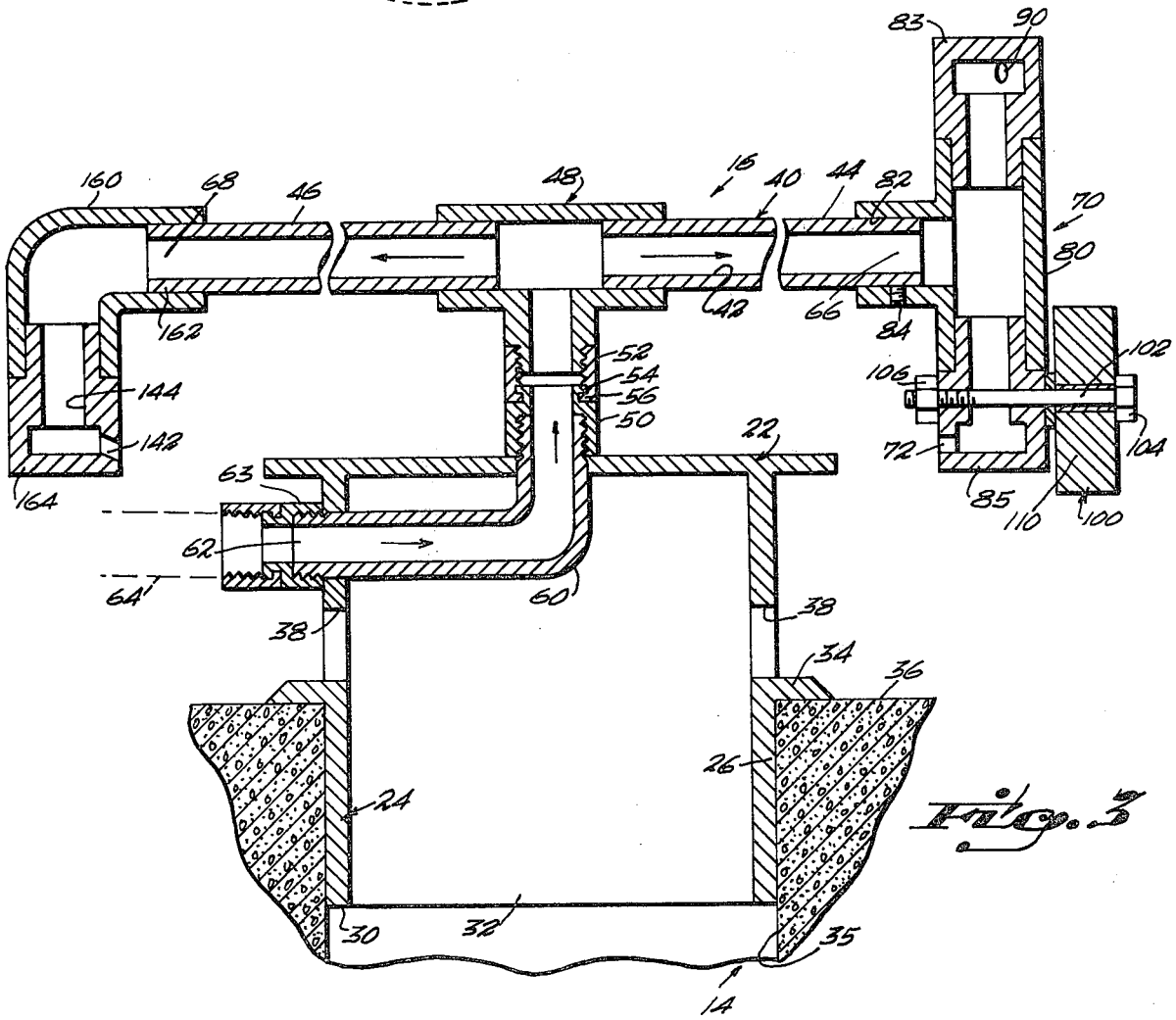
FIG. 3 is a view in cross section taken on the plane indicated by the line 3—3 of FIG. 2 and looking in the direction of the arrows.

In the illustrated preferred embodiment, as seen in FIG. 3 the lower end 30 of the housing is open as at 32 and comprises an outlet of the housing. Intermediate the heighth of the housing an exterior radially extending flange or shelf means 34 is provided which is of a cross sectional area greater than that of most conventional pool drain openings represented by the numeral 35 and provides a foot means for supporting the unit on the floor 36 of the pool to which it is installed. Above the pool floor level and, preferably closely adjacent thereto, a plurality of inlet openings are provided in the housing wall, such as that designated by the numeral 38. Above the housing a laterally extending tubular arm 40 is provided which defines an interior laterally extending column 42 therethrough. In the illustrated preferred embodiment the tubular length 40 includes a first longer length portion 44 and a second shorter length portion 46 which is preferably about one-half of the length of the first mentioned portion. Means are provided to connect the arm 40 to the housing. In the illustrated preferred embodiment this comprises a spindle means 48. Generally speaking, the spindle means includes a lower member 50 and an upper member 52 which are rotatably interconnected as by the mating flanges 54 and 56 and include threaded socket means for male and female connection of the spindle parts as illustrated in FIG. 3. The spindle is in open communication with an elbow section 60 preferably secured within the housing and with an open terminal end 62 below the arm and which is provided with means to connect to a discharge end 63 of a hose length 64 as by the threaded engagement shown. It is thus seen that when water is flowed in the direction of the arrows through the elbow section 60 and means to connect, it will be directed outwardly through the tubular lengths to the opposite terminal ends 66 and 68 respectively, see FIG. 2.

Referring first to the longer length, there is provided a jet nozzle assembly indicated by the numeral 70 in FIG. 2 having a radially inwardly facing opening 72, see FIG. 3 to direct a stream of water radially inwardly toward the housing. In the illustrated embodiment, a T member 80 may be secured as by glue as at 82 or a screw as at 84 to the terminal end of the tubular length. A jet orifice is also provided as indicated by the numeral 90 to face in an opposite direction from that in which the arm is intended to be rotated in the cleaning operation and which causes the arm to rotate about the housing by reason of the general principle of opposite reactions in physics. This comprises means to rotate the arm. Also, in the preferred embodiment, the T shaped member 80 is provided with an upper end cap 83 and a lower end cap 85 each having the openings referred to above, namely, those designated by the numerals 72 and 90. Also, the end cap 85 is preferably provided with a wheel means 100 having an axle 102 supported on the cap and held in position as by the headed end 104 and the threaded nut 106 and rotatably supporting a wheel 110 which, on rotation of the arm, travels in a circular path on the floor of the pool. Also, as seen in FIG. 1, a float means designated by the numeral 120 may be provided intermediate the length of the arm or tubular piece such as a buoyant body 122 with means to connect it to the arm such as a rope or string 124. To the shorter end 46, as shown in FIG. 3, there is also provided a radially inwardly facing opening 142 which is connected through the passageway 144 to the column 68 of the tubular length for conducting fluid flow therethrough to move debris inwardly towards the openings 38 of the housing. In the preferred embodiment an elbow 160 is provided on the terminal end 162 of the shorter length 46 of the tubular length 44 with a cap 164 secured thereto with the radially inwardly facing opening 142.

What is claimed is:

1. For cleaning a pool having an associated circulating pump means, a device comprising:

a housing having an upper end, a lower end and axially extending side walls and defining an interior chamber with a plurality of circumferentially spaced radially outwardly facing inlet ports in the wall and an outlet opening, means to connect the outlet to the circulating pump, a radially extending tubular arm and means rotatably connecting the arm to the housing for rotation with respect to the housing and said arm having an interior through passageway and said arm having an opening in fluid communication with a passageway through said means to connect, and means on said device for connecting a hose to flow water through said means to connect and said passageway, a water jet assembly supported distally on the tubular arm radially spaced outwardly from the housing and defining an interior passageway with a radially inwardly facing opening to direct water flowing through the means to connect and column toward the housing and said inlet ports, and means to turn the arm.

2. The device as set forth in claim 1 wherein said means to turn the arm comprises an orifice located radially outwardly of said housing to direct a stream of water in one direction from the arm to propel the arm in the opposite direction in accordance with Newton's Law of equal and opposite reaction.

3. The device as set forth in claim 2 wherein said orifice is arranged in said water jet nozzle assembly.

4. The device as set forth in claim 3 wherein wheel means are provided, and means located radially outwardly of said inwardly facing opening to journal the wheel means to the water jet nozzle assembly for wheeled engagement with the floor of a pool, the axis of rotation of said wheel means being parallel to the axis of the tubular arm.

5. The device as set forth in claim 4 wherein float means are included with said tubular arm intermediate said means to connect and said water jet nozzle assembly to reduce the effective weight at the wheel means of the water jet nozzle assembly.

6. The device as set forth in claim 3 wherein said water jet nozzle assembly comprises a T member having its stem interconnected with the terminal end of said tubular length and with the bar of said T extending generally vertically to distal end zones above and below the center line of said tubular length respectively and said orifice opening being respectively above said center line of said tubular length and below said arm and radially facing inwardly.

7. The device as set forth in claim 1 wherein said lower end is sized for receipt in a drain opening in the floor of a pool and includes laterally extending shelf means to rest on the floor of a pool, said shelf means perpherally extending from said wall of said housing.

8. The device as set forth in claim 7 wherein the peripheral edge of said shelf is beveled inwardly and upwardly.

9. The device as set forth in claim 1 wherein said means to connect comprises spindle means journaled for rotation to the upper end of said housing and said spindle means having a through opening.

10. The device as set forth in claim 1 wherein said tubular length is connected intermediate its length to said means to connect and includes a first and a second portion, said first portion being of a first predetermined length and said second portion being of a second predetermined length, said second predetermined length being shorter than said first predetermined length, said second predetermined length having at its terminal end, a nozzle assembly means with an opening facing radially inwardly below the axis of said tubular length.

* * * * *